United States Patent [19]

Selsam

[11] 4,155,287

[45] May 22, 1979

[54] HYDRAULICALLY OPERATED IMPACT DEVICES

[75] Inventor: Roger L. Selsam, Fairport, N.Y.

[73] Assignee: Hydroacoustics Inc., Rochester, N.Y.

[21] Appl. No.: 855,658

[22] Filed: Nov. 30, 1977

[51] Int. Cl.[2] ..... F01B 7/18; F01L 25/06

[52] U.S. Cl. ..... 91/219; 91/321; 91/337

[58] Field of Search ..... 91/337, 322, 319, 301, 91/321

[56] References Cited

U.S. PATENT DOCUMENTS

| | | | |
|---|---|---|---|
| 3,376,791 | 4/1968 | Ashfield et al. | 91/337 |
| 3,513,917 | 5/1970 | Stober | 91/319 |
| 3,540,349 | 11/1970 | Pennther | 91/319 |
| 3,643,548 | 2/1972 | Butterworth | 91/319 |
| 4,020,744 | 5/1977 | Swenson | 91/337 |

*Primary Examiner*—Paul E. Maslousky

*Attorney, Agent, or Firm*—Martin LuKacher

[57] ABSTRACT

Hydraulic actuation of a device for delivering impact energy to a load, such as a pile driver, is provided by a hydraulically operated oscillator having a piston which is reciprocal in a cylinder under hydraulic forces developed by pressurized hydraulic fluid in the cylinder which is switched from supply to return pressure by a valve. The valve is actuated between switching positions by means of trip ports opened and closed by spaced flats on a rod which connect the piston to an impact delivering member, such as the ram of the pile driver. The trip ports are connected to the valve for applying pressurized hydraulic fluid either at supply or return pressure thereto so as to shift the valve between the switching positions. The valve is bi-stable in either of its switching positions through the use of latching ports and restricted passageways through which hydraulic fluid flows in amounts sufficient to make up for leakage through the valve which would otherwise allow the valve to drift.

7 Claims, 5 Drawing Figures

HYDRAULICALLY OPERATED IMPACT DEVICES

Figure 1:
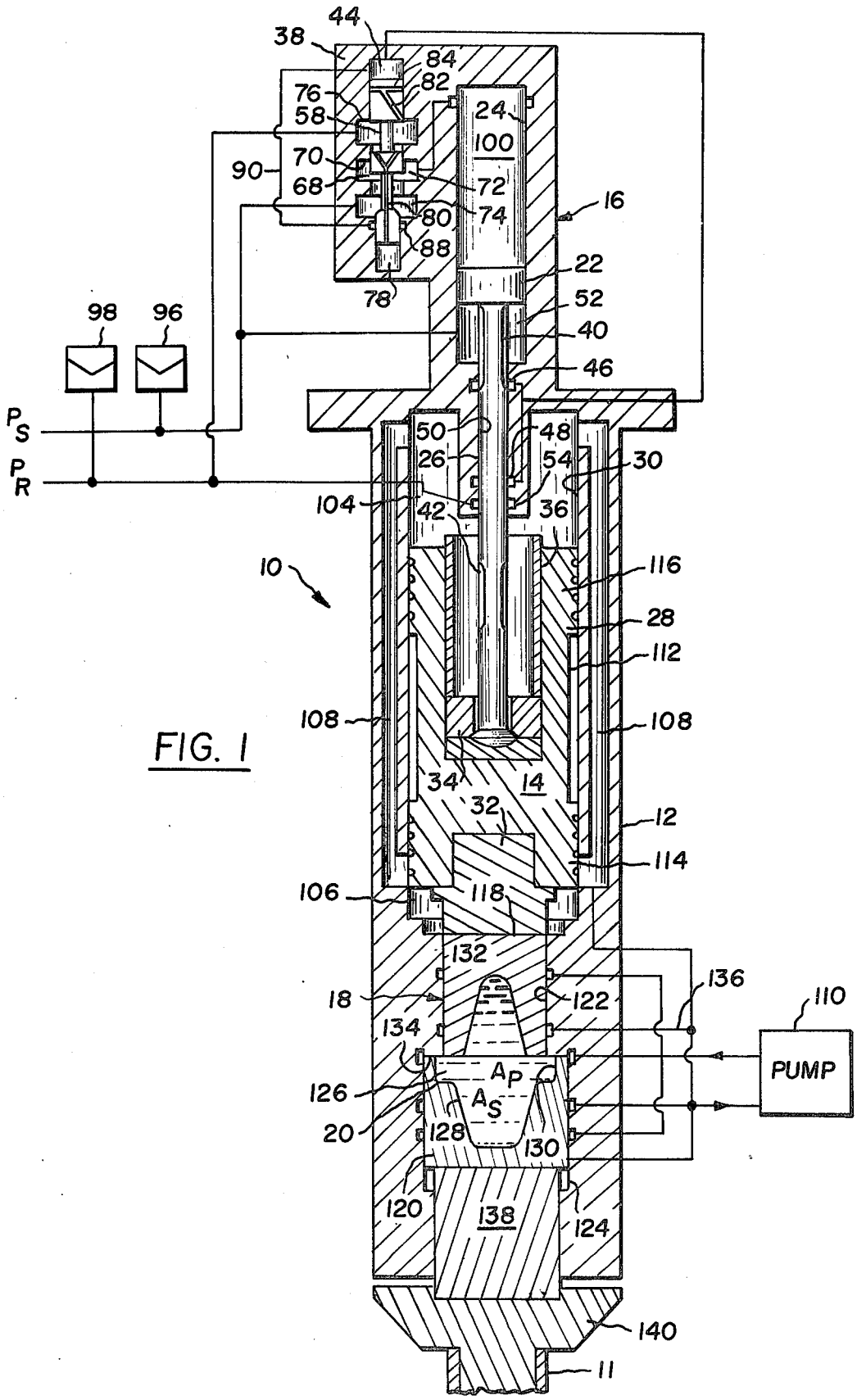

The present invention relates to hydraulically operated impact devices and to hydraulically operated oscillators for driving such impact devices.

The invention is especially suitable for use in pile drivers and also other impact devices which have a relatively slow repetition frequency.

Valve actuation for pile drivers is generally accomplished mechanically through cam surfaces on a slide bar that moves up and down with the ram. The valve is switched at the proper point in the cycle and is held at one end or the other of its travel between switching events by friction and/or by flats on the cam surfaces. This procedure is not suitable for high speed operation because of the inertia and wear of the mechanical moving parts. In general, several added parts such as cranks and rollers in addition to the slide bar are also required to translate motion from the ram to valve. Since the valve must be mechanically actuated, it requires additional external seal points which are prone to leak.

In hydraulic percussive drills, where frequencies are much higher and strokes much shorter, several techniques for hydraulically actuating the valve through trip ports in the hammer member and the cylinder have been evolved (see for example U.S. Pat. No. 3,774,502 to Arndt, issued Nov. 27, 1973, and U.S. Pat. No. 3,780,621 to Romell, issued Dec. 25, 1973). Such techniques, if applied directly to a pile driver or other lower frequency impact device would have two principal shortcomings:

(1) They would result in an excessively long hammer.

(2) Because of the relatively long periods of even "high frequency" pile driving, the valve can drift between switching events, reducing the efficiency of the hammer. Also, the hammer and valve can find intermediate positions of static stability so that the oscillator sequence does not infallibly start when pressure is applied to the unit.

It is a feature of this invention to provide an improved hydraulic driver having a hydraulic oscillator which when used as a driver for the ram of a hydraulic pile driver, minimizes the length of the pile driver, is regeneratively bi-stable, and requires no added mechanical parts or external seals.

It is an object of the invention to provide an improved hydraulic oscillator.

It is a further object of the invention to provide an improved hydraulic oscillator for actuating and driving the ram of a pile driver.

It is a still further object of the invention to provide a valved hydraulic oscillator which is capable of providing reliable high power reciprocating motion at relatively low repetition frequencies of about 200 cycles per minute and less.

Briefly described, a hydraulically operated impact device embodying the invention has a piston which is reciprocal in a cylinder in a housing. The piston is connected by a rod to a member for delivering impact energy to a load, such as the ram of a pile driver. The lower piston area in the cylinder is always exposed to supply pressure, while the upper area is exposed to pressure which is switched between supply and return pressure during the driving and the retraction portion of the cycle. When the upper piston area is exposed to return pressure, which occurs after impact, the piston and ram is driven upwardly. Then the upper piston area is switched to supply pressure. The piston and ram are decelerated downwardly. The piston reaches zero velocity at the top of its stroke and then travels downwardly to the impact point. A valve is positionable in either of two switching positions and switches the pressure in the cylinder to which the upper piston area is exposed between supply and return pressure. The valve has a control chamber. The piston rod has upper flats which cooperate with an upper trip port in the housing bore in which the rod reciprocates. The piston rod also has lower flats which cooperate with a lower trip port. To actuate the valve between its switching positions, the pressure in the valve control chamber is switched via the upper flats and the upper trip port at the impact point and via the lower flats and lower trip port at a point during (suitably midway of) the return stroke. Latching ports and restricted passageways allow pressurized fluid to flow with respect to the valve control chamber and maintain the valve bistable in one or the other of its switching positions until the pressure in the control chamber is switched at the bottom of forward stroke (at the impact point) and on the return stroke.

Figure 2:
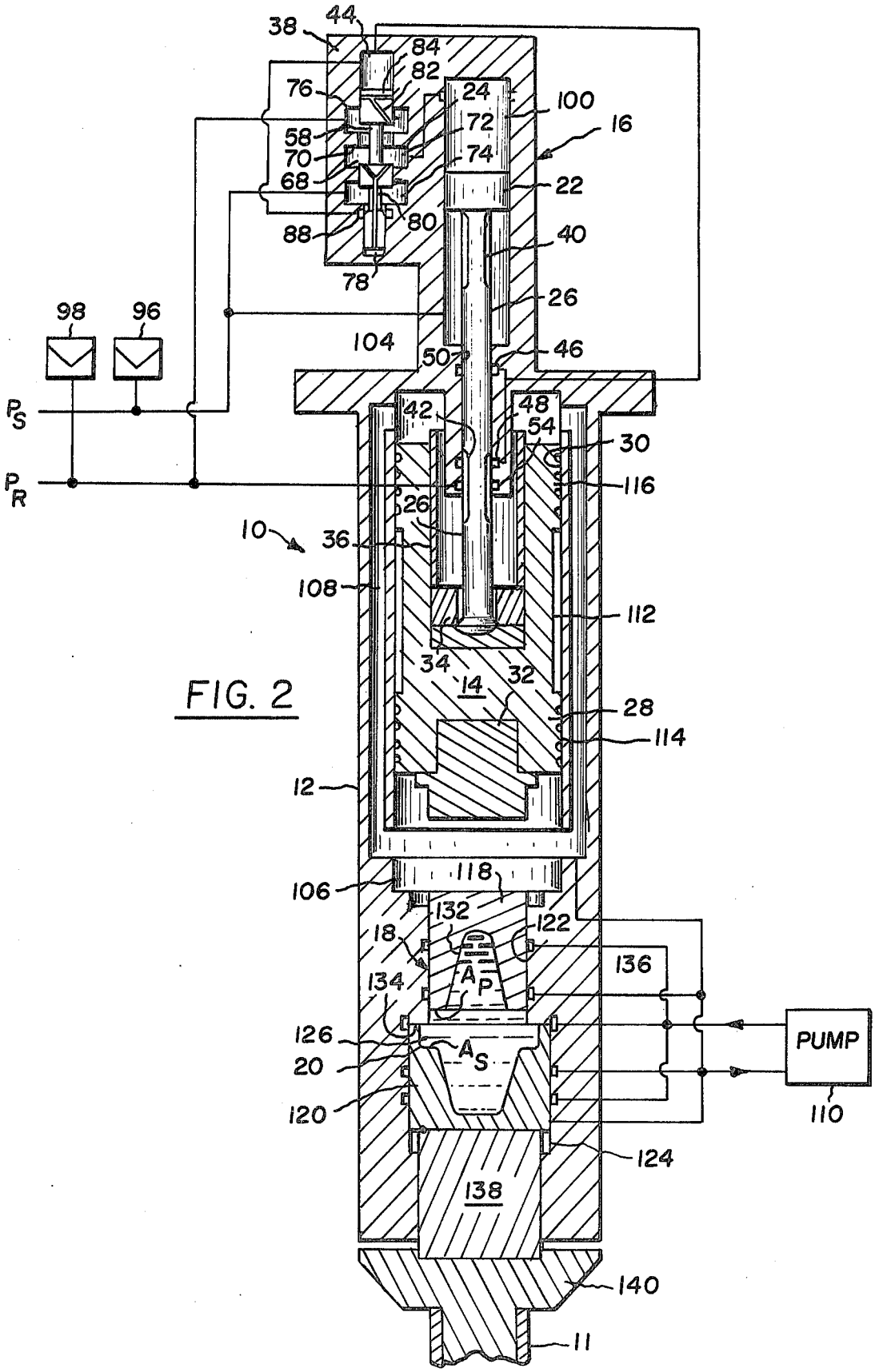
Figure 4:
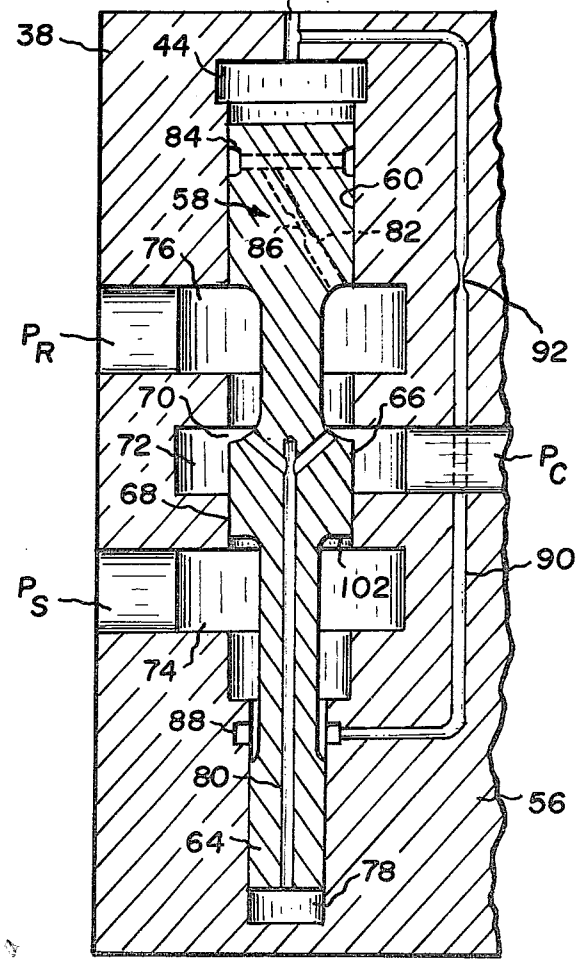
Figure 3:
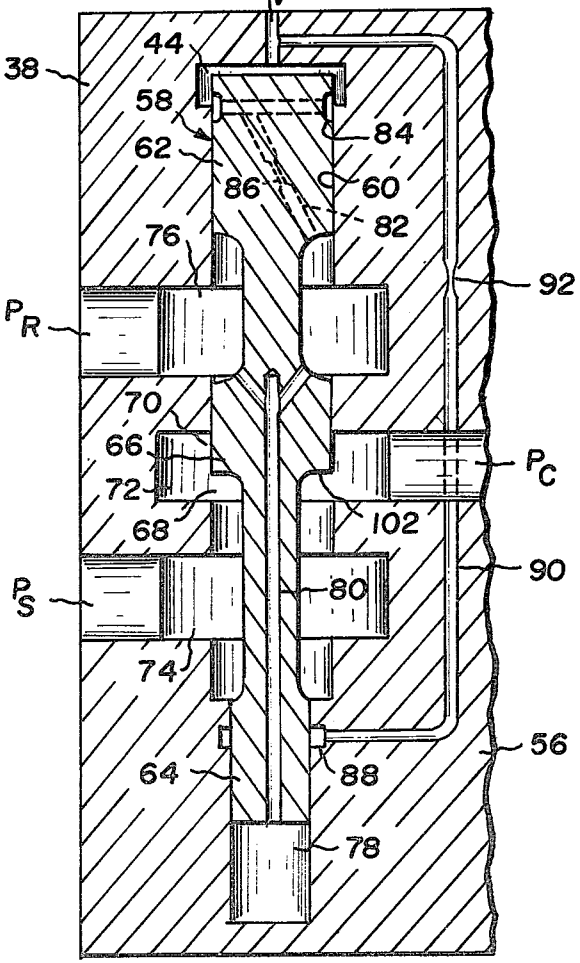
Figure 5:
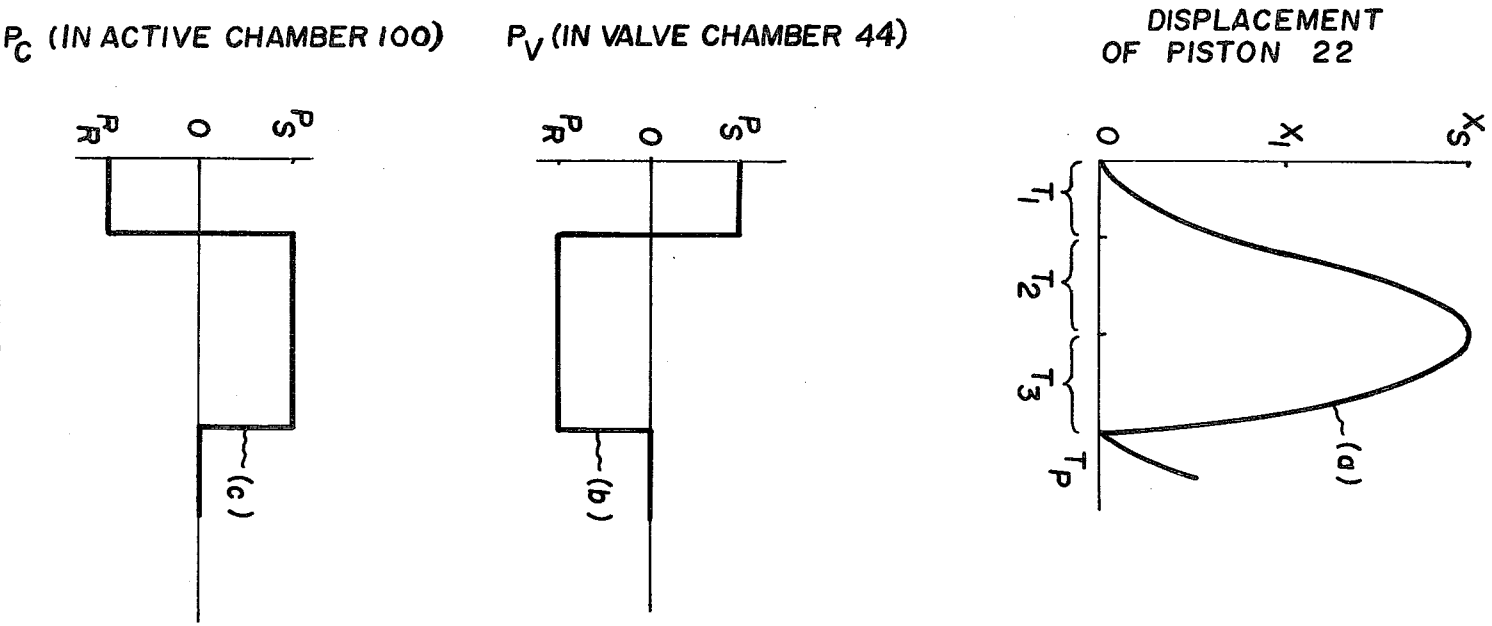

The foregoing and other objects, features and advantages of the invention as well as a presently preferred embodiment thereof will become more apparent from a reading of the following description in connection with the accompanying drawings in which:

FIGS. 1 and 2 are simplified sectional views in elevation of a pile driving hammer having a hydraulic oscillator embodying the invention during the driving and during the retracting portions of the cycle, respectively;

FIGS. 3 and 4 are enlarged sectional views of the control valve of the oscillator shown in FIGS. 1 and 2 in the positions which the valve achieves during the driving and during the retracting portions of the cycle respectively; and FIG. 5 shows waveforms of displacement of the piston of the oscillator and the ram of the hammer shown in FIGS. 1 and 2 and of the actuating pressures operating on the piston and the valve.

Referring first to FIGS. 1 and 2, there is shown a hydraulic pile driving hammer 10 disposed in driving position on the top of a pile 11. The pile may be a hollow member such as a step tapered pile. Other piles such as "H" piles or solid piles may be driven with the hammer 10. A housing 12 contains a ram assembly 14 (including a ram 28 in an air filled cylinder 30), a hydraulically operated oscillator 16, and a cap block assembly 18. A hydraulic spring transformer 20 is located in the cap block assembly 18 and it and hydrostatic bearings associated therewith are filled with pressurized hydraulic fluid, by a pump 110. The housing may in practice be constructed in parts and with liners for ease of assembly. A prestressed cable and columns of the type conventionally used in pile driving hammers may assemble these parts together. The hammer may have a sheave assembly at its upper end. A crane may be used to pick up the hammer and associated leads. By moving the crane, the hammer and the leads may be moved from one pile driving location to another. A hydraulic power supply, which may consist of a diesel engine, a pump and associated reservoirs and filters, provides hydraulic fluid at elevated or supply pressure, $P_S$ and return pressure indicated at $P_R$. The return pressure side of the supply may be connected to the reservoir.

By way of example, the hammer 10 may be designed to deliver impact energy rates at 32,500 ft. lbs. The length of the hammer may typically be about 16 ft., with the diameter across the housing 12 being about 3 ft. The weight of the hammer may be about 20,000 lbs, and the weight of the ram may be about 3000 lbs. The ram impact velocity may be 26ft/sec. The spring transformer can make the ram appear to the pile as weighing 9000 lbs effectively, impacting at an effective velocity of 15 ft/sec. The hydraulic spring transformer 20 and the associated lightweight ram system enables the blow frequency to be about 200 blows per minute. At this blow energy and frequency, under normal circumstances, (9000 lb ram impacting at 15 ft/sec) the hammer weight which would be required to maintain the hammer engaged with the pile would be about 40,000 lbs. Thus, with the use of the hydraulic spring transformer and associated light weight ram, the hammer weight has been reduced by a factor of about 2. The hydraulic spring transformer makes the lightweight ram travelling at high velocity appear to the pile like a large heavy ram travelling at low velocity. The lightest weight and highest velocity commensurate with the life and reliability of the striking system can therefore be used in a pile driving hammer embodying the invention. The pile driver hammer is the subject matter of U.S. patent application Ser. No. 856,059 filed on the same date as this application, in the name of John V. Bouyoucos and assigned to the same assignee as this application.

The hydraulic oscillator consists of an actuating piston 22 which reciprocates in a cylinder 24 provided by a bore in the upper end of the housing 12. A rod 26 connects the piston 22 to the ram assembly 14. This assembly includes a ram 28 which has a sliding fit within the cylinder 30 which is provided by a bore in the housing 12. A ram point 32 is provided at the lower end of the ram to take the impact stresses when the ram strikes at the end of the forward stroke of the ram. The piston rod 26 is attached to the ram by means of locking discs 34, which are held in place by a retainer cylinder 36. This cylinder 36 may be threaded into the ram 28. The hydraulic driver 16 incorporates a valve 38. Upper and lower flats 40 and 42 on the piston rod 26 actuate the valve 38 by supplying pressurized hydraulic fluid at supply or return pressure via upper and lower trip ports 46 and 48 to a control chamber 44 at the upper end of the spool 58. These trip ports may be grooves in a bore 50 in the housing in which the piston rod 26 reciprocates. The upper flats 40 connect a lower chamber 52 in the cylinder 24 to the upper trip port 46 at the end of the forward stroke of the ram. A peripheral groove 54 located below the lower trip port 48 in the bore 50 provides a return port which is connected continuously to return $P_R$. The lower flat 42 connects this return port (the groove 54) to the lower trip port 48 during and suitably at the middle of the return stroke of the ram, as may be observed from FIG. 2.

As may be observed also in FIGS. 3 and 4 the valve 38 has its own housing 56 which may be separate from and attached to the housing 12, although shown integral with the housing 12 in FIGS. 1 and 2. A spool 58 has a sliding fit in a bore 60 in the valve housing 56. The upper end, 62 of the spool is of larger diameter than the lower end 64 thereof. A central land 66 of the spool 58 defines supply and return switching ports 68 and 70 with the lower and upper edges of a central groove 72 in the bore 60. When the supply port 68 is open, the central groove 72 is connected to a lower groove 74 in the bore 60. When the return port 70 is open, the central groove 72 is connected to an upper groove 76 in the bore 60.

A chamber 78 at the lower end of the valve is continuously connected to the region defined by the upper groove 76 through the spool 62.

The valve 38 has means for latching itself in the upper position as shown in FIG. 3 with the port 68 open, or in the position shown in FIG. 4 with the port 70 open. The valve 38 in operation is a bi-stable device. The valve is latched in the upper position by means of a passageway 82 between a peripheral groove 84 near the upper end of the valve and the region of the groove 76. The groove 84 is open to the upper end chamber 44 when the spool 58 is in the upper position, as shown in FIG. 3. When the spool is in the lower position, as shown in FIG. 4, the groove 84 is closed by the bore 60 from the upper end chamber 44. The latching passageway 82 is restricted as by being narrow or by being formed with an orifice 86. By restricted is meant that the passageway 82 provides a much narrower path for fluid than is provided by the switching ports 68 and 70. The passageway 82 is sufficiently large to make up for leakage paths around the periphery of the spool and the bore 60 and around the piston rod 26 and in its bore 50, which would otherwise allow the spool 58 to drift.

The groove 84 acts as a latching port when the spool is in its upper position, shown in FIG. 3. Another groove 88 provides another latching port which is operative to latch the valve with the spool 58 in the downward position, shown in FIG. 4. This groove 88 is in the periphery of the bore 60 and is opened and closed by the lower end 64 of the spool 58. Another latching passageway 90 which is also restricted, as by an orifice, connects the latching port 88 to the upper end chamber 44. This latching passageway 90 is restricted relative to the switching ports 68 and 70 but is sufficiently large relative to the possible leakage paths as may exist between the periphery of the spool 58 and the bore 60, so as to prevent drifting of the spool 58.

The hydraulic circuit of the driver 16 includes accumulators 96 and 98 connected to the supply and return lines from the hydraulic power system. These accumulators smooth the pressure fluctuations in the system which are presented to the hydraulic power supply, and may be the type using pressurized gas biased diaphragms or pistons.

The piston 22 divides the cylinder into the lower chamber 52 and an upper chamber 100 which may be referred to as the active chamber. The pressure in this chamber 100 is switched between supply and return pressure by the valve 38. The upper area of the piston 22 which faces the active chamber 100 is larger than the lower area which faces the chamber 52. The effective areas are those presented in a plane perpendicular to the axis of the piston which is the axis along which the piston moves. The upper area of the piston 22 may suitably be twice that of the lower area. The lower chamber 52 is always connected to supply pressure, $P_S$. When the active chamber 100 is connected to supply pressure, there is a force of magnitude $P_S(A_U-A_L)$ urging the piston 22 and the ram assembly 14 which is connected thereto, downward. $A_U$ is the upper area of the piston 22 and $A_L$ is the lower area thereof. When the active chamber 100 is connected to return pressure $P_R$ there is a hydraulic force of magnitude $P_SA_L-P_RA_U$, directed upwardly. This upward hydraulic force moves the piston 22, the rod 26 and the ram assembly 14 upwardly away from the pile 11.

Supply pressure, $P_S$, is connected to the cavity defined by the lower groove 74 in the valve bore 60. Return pressure $P_R$ is applied to the upper groove cavity 76. The active chamber 100 is connected to the central chamber 72. The pressure in the active chamber, shown as $P_C$ in FIGS. 3, 4 and 5, is switched by the valve between $P_S$ and $P_R$. With the spool 58 in the upper position, as shown in FIGS. 1 and 3, the supply switching port 68 is open. This applies supply pressure $P_S$ to the active chamber 100 as shown in FIGS. 1 and 3. With the spool 58 in the lower position, as shown in FIGS. 2 and 4, the return switching port 70 is open. This applies return pressure $P_R$ to the active chamber 100.

The position of the valve spool 58 is controlled by the position of the ram 28. When the ram and the piston rod 26 approach the bottom of the forward stroke, the upper flats 40 reach the position shown in FIG. 1, which is the position of the ram just before impact. At impact, the connection is made by way of the flats 40 between the lower chamber 52 and the upper trip port 46. The hydraulic fluid at supply pressure from the lower chamber 52 then flows into the upper end chamber 44 of the valve 38. The lower chamber 78 is maintained at return pressure since it is connected to the upper cavity 76 which in turn is connected to the return side of the hydraulic power supply at $P_R$. The net hydraulic force on the spool 58 moves the spool downward from the position shown in FIGS. 1 and 3 to the position shown in FIGS. 2 and 4. The switching port 68 closes while the switching port 70 opens and the pressure in the upper chamber is switched to return.

The ram 28 then moves upwardly until the lower flats 42 connect the lower trip port 48 to return via the porting groove 54. Return pressure is then switched to the upper end chamber 44 of the valve 38 (see FIG. 5(b)). Supply pressure is always applied to the step 102 of the central land of the spool 58. The net hydraulic force on the spool 58 is therefore in the upward direction. The spool moves upwardly from the position shown in FIGS. 2 and 4 to the position shown in FIGS. 1 and 3. The active chamber 100 is connected to supply pressure (see FIG. 5(c)).

The downward hydraulic force on the piston 22 first decelerates the upward motion of the ram assembly 14. The ram eventually reaches zero velocity at the end of the retraction or return stroke. Then the ram is accelerated downward to impact the pile 12 via the hydraulic spring transformer 18. The lower flats 42 are positioned to actuate the valve 38 so as to switch the active chamber 100 from return to supply pressure suitably at a point midway in the return stroke of the ram. This is the "symmetrically switched" case, and results in a motion history which is shown in FIG. 5(*a*).

When the valve spool 58 is driven downwardly, to switch the pressure in the active chamber 100 from supply to return, latching port 88 is opened to the lower cavity 74 which is always at supply pressure, $P_S$, (see FIG. 4). Supply pressure is then applied via the restricted passageway 90 to the upper end chamber 44 and latches the spool in downward position. The spool remains latched until the valve is tripped when the control pressure, indicated at $P_V$ in FIGS. 4 and 5(*b*) is switched from supply to return pressure $P_R$ via the return porting groove 54, the lower flats 42 and the lower trip port 48. The spool 58 is then driven to the upper position, shown in FIG. 3 and the lower latching port 88 is closed.

The upper latching groove 84 connects the cavity 76 to the upper end chamber 44, via the restricted passageway 82. The upper end chamber 44 is maintained at return pressure, and the valve 38 is latched with the spool 58 in its upward position until it is tripped at the end of the downward stroke of the ram (after $T_P$—FIG. 5(*a*)) by the upper flats 40 and the upper trip port 46.

Because the flow through the restricted passageways 82 and 90 makes up for leakage into or out of the upper end chamber 44, the valve is latched and does not drift. There are no positions of stability of the spool 58 other than the position at the top of the valve spool travel shown in FIG. 3 or at the bottom of the valve spool travel shown in FIG. 4. The hydraulic oscillator provided by the piston 22, the piston rod 26, the valve 38 and its hydraulic circuitry will start up and begin oscillating as soon as the pressurized fluid is applied to the hammer. Even at the relatively long intervals between switching of pressure, the valving is positive and inopportune switching is obviated. Another advantage of the hydraulic driver is that it is entirely hydraulically actuated, and cams or other mechanical actuators which move up and down with the ram are not needed. The reliability of the driver even with high frequency pile driving, say, at 200 blows per minute, is much improved over mechanical valve actuation. Simplifications in valve design are also obtained since the effect of leakage in the valve are counteracted without the need for special seals.

Another advantage of the hydraulic driver is that additional ram length is not required to accommodate trip ports in the hammer housing and on the ram. The portion of the housing containing the bore 50 in which the trip ports 46 and 48 and the porting groove 54 are located is of a diameter less than the diameter of the retainer cylinder 36. The total length which is necessary for switching the valve control pressure $P_v$ is one half the stroke length, where switching occurs at the middle of the return stroke. This length is in part accommodated by an extension of the housing portion which contains the bore 50 into which the ram may fit.

Various modifications in the hydraulic oscillator may be made. For example the upper trip port 46 may be eliminated if the upper flats 40 are lengthened; however, this will cause the overall length of the hammer to increase.

The cylinder 30 in the housing 12 in which the ram 24 reciprocates is primarily air filled. The regions 104 and 106 and the opposite ends of the bore are interconnected by passages 108 which may be in the form of a gallery with radial holes at the opposite ends thereof into the regions 104 and 106. The air-filled bore or cylinder 30 minimizes losses as the air is allowed to circulate through the passageway 108 between the air-filled regions 104 and 106. Oil is allowed to leak into the ram cylinder 30. Such leakage is downwardly in the bearing between the piston rod 26 and the bore 50. Hydraulic oil also leaks upwardly into the cylinder 30 from the hydraulic spring transformer 18. The oil level at the bottom of the cylinder 30 (viz, in the region 106) is maintained by means of a pump 110 which supplies pressurized hydraulic fluid for the hydraulic spring transformer. This pump 110 may be a separate scavenging pump. Alternatively, the main hydraulic supply may be used with a pressure regulator to reduce the pressure for the hydraulic spring transformer and the bearings at the lower end of the hammer. The residual oil in the lower region 106 has the advantage of providing a dash pot damper which can absorb the ram energy in the event of the pile running. The ram may have a central groove 112 which defines bearing areas of lands 114 and 116. These lands contain grooves which serve as oil reservoirs and dirt collectors.

The hydraulic spring transformer consists of an upper piston 118 and a lower piston 120 which are slidably mounted in bores 122 and 124 in the housing. These pistons 118 and 120 are centered in their bores 122 and 124 as by tapered hydrostatic bearings which are fed from the pump 110. A chamber 126 is defined in the housing between the opposed ends of the transformer pistons 118 and 120. The lower piston 120 has a generally concave opening 128. The upper portion of this opening 128 is a bore 130 having a diameter slightly larger than the diameter of the upper piston 118. A generally concave opening is also formed in the lower end of the upper piston 118. The upper piston 118 can move upwardly and downwardly. The lower piston 120 can move downwardly. Its upper motion is stopped by a step 134 in the housing 12. The chamber 126 is therefore a variable volume chamber. This chamber is filled with hydraulic oil under pressure which is supplied by the pump 110. The volume of liquid in the chamber 126 forms a hydraulic spring. The hydraulic oil circulates through the spring which serves to replenish any liquid loss through leakage and to cool the hydraulic spring transformer assembly 18.

Between inpact events (after each blow), the upper piston in forced upwardly, which uncovers a port to a return line 136 to the pump 110. This limits the pressure in the hydraulic spring chamber 126 to a given low value between blows (the return pressure of the pump 110), and insures the flow through the spring chamber 126, which replenishes the liquid and cools the assembly 18.

Various modifications in the hydraulic oscillator may be made. For example the upper trip port 46 may be eliminated if the upper flats 40 are lengthened; however, this will cause the overall length of the hammer to increase. Other variations and modifications will undoubtedly become apparent to those skilled in the art. Accordingly, the foregoing description should be taken as illustrative and not in any limiting sense.

What is claimed is:

1. In a hydraulically operated oscillator for developing impact energy which is adapted to be delivered to a load, and having a housing, a cylinder in said housing, a piston reciprocable in said cylinder, said piston having an area facing an active chamber in said cylinder, a valve having a member reciprocable between first and second positions for switching the pressurized fluid in said active chamber between supply to return pressures for developing hydraulic forces on said piston which drive said piston in opposite directions toward and away from the load, said valve having a control chamber, said valve member having an area facing said control chamber, and ports opened and closed by said piston as it moves over given distances in different ones of said opposite directions, said ports being connected to said control chamber for switching pressurized fluid in said control chamber for developing hydraulic forces on said valve member to shift said valve member between said first and second positions, the improvement which comprises a pair of latching ports which are alternatively opened and closed when said valve member is in said first and second positions, passageways for the pressurized fluid switched by said valve member which extend between said latching ports and said control chamber to keep said valve member in said first position when it is shifted from said second position to said first position and to keep said valve member in said second position when it is shifted from said second position to said first position, said passageways being restricted so as to be smaller than the fluid paths through said valve to said active chamber and sufficiently large relative to the leakage paths for hydraulic fluid around said valve member, said valve member being a spool, said housing having a bore in which said spool is reciprocable, said control chamber being disposed at one end of said spool, said spool and said cylinder defining at least three cavities, said spool having a land defining with said cylinder first and second switching ports between a first of said cavities and between a second and a third of said cavities, a channel for said hydraulic fluid at supply pressure to said second cavity, a channel for pressurized hydraulic fluid at return pressure to said third cavity, a channel between said first cavity and said active chamber, one of said latching ports being disposed between one of said second and third cavities and said control chamber, the other of said latching ports being disposed between the other of said second and third chamber and the end of said spool opposite from said control chamber, whereby the pressurized fluid switched through said first switching port is supplied to said control chamber when said spool is in said first position via one of said restricted passageways and the pressurized fluid which is switched through said second switching port is supplied to said control chamber when said spool is in said second position via the other of said restricted passageways, said restricted passageways presenting a substantially smaller area to the flow of said pressurized fluid therethrough than said switching ports, said one latching port being provided by an opening in the periphery of said spool and said other latching port being provided by an opening in the periphery of said bore.

2. The invention as set forth in claim 1 wherein said one of said restricted passageways is in said spool and said other of said restricted passageways is in said housing.

3. The invention as set forth in claim 2 wherein said one passageway connects said third chamber and said one latching port, and said other passageway connects said other latching port and said control chamber, and another chamber in said bore at the opposite end of said spool, a chamber connecting said chamber to receive said pressurized fluid at return pressure.

4. The invention as set forth in claim 3 wherein said last named channel is in said spool between said third cavity and said opposite end chamber.

5. In a hydraulically operated pile driver having a ram which develops impact energy for delivery to a pile, a hydraulic oscillator which comprises a cylinder, a differential area piston in said cylinder, a piston rod extending from one end of said piston and connected to said ram, said one end of said piston presenting a smaller area to said cylinder than the opposite end thereof, said one end and said opposite end respectively defining first and second chambers in said cylinder, said first chamber continuously receiving hydraulic fluid at supply pressure, a valve shiftable between first and second positions for switching hydraulic fluid in said second chamber between supply to return pressuures, said piston rod having first and second flats respectively disposed nearer to said piston and nearer to said ram, a plurality of ports between said flats adapted to be opened by said flats and closed by the portion of said rod between said flats, at least one of said ports being connected to said valve and another of said ports being connected to continuously receive pressurized fluid at return pressure, said first flat providing a connection between said one port and said first chamber, and said second flat providing a connection between said one port and said other port whereby to apply hydraulic forces on said valve for shifting said valve between said first and second positions when said ram reaches different positions in its travel toward and away from the pile.

6. The invention as set forth in claim 5 wherein said valve includes latching means for making said valve bi-stable in said first and second positions.

7. The invention as set forth in claim 5 wherein said ports are three in number said one port being a first of said three ports, and providing an upper trip port, a second of said third ports being spaced away from said first trip port toward said pile and providing a lower trip port, said other port being spaced from said lower trip port a distance less than the length of said second flat, said upper trip port being spaced from said second chamber a distance less than the length of said first flat, said trip ports being connected to said valve.

* * * * *